US007686644B2

(12) United States Patent
Chu et al.

(10) Patent No.: US 7,686,644 B2
(45) Date of Patent: Mar. 30, 2010

(54) BATTERY CONNECTOR

(75) Inventors: Ping-Chuan Chu, Taipei Hsien (TW); Shun-Hua Zhang, Taipei Hsien (TW)

(73) Assignee: Advanced ConnecTek, Inc. (TW)

( * ) Notice: Subject to any disclaimer, the term of this patent is extended or adjusted under 35 U.S.C. 154(b) by 0 days.

(21) Appl. No.: 12/232,848

(22) Filed: Sep. 25, 2008

(65) Prior Publication Data

US 2009/0170374 A1 Jul. 2, 2009

(30) Foreign Application Priority Data

Dec. 28, 2007 (TW) ..... 96222375 U

(51) Int. Cl.
*H01R 3/00* (2006.01)

(52) U.S. Cl. ..... 439/500; 439/271; 439/862

(58) Field of Classification Search ..... 439/500, 439/271, 626, 627, 862
See application file for complete search history.

(56) References Cited

U.S. PATENT DOCUMENTS 6,447,338 B1 * 9/2002 Bricaud et al. ..... 439/630
6,984,130 B2 * 1/2006 Richter et al. ..... 439/66
7,037,113 B2 * 5/2006 Soh ..... 439/66
D528,985 S * 9/2006 Peng ..... D13/147
7,357,665 B1 * 4/2008 Yan ..... 439/500
7,387,541 B1 * 6/2008 Lai et al. ..... 439/660
2002/0019179 A1 * 2/2002 Masumoto ..... 439/862
2007/0212918 A1 * 9/2007 Gruebel et al. ..... 439/271

* cited by examiner

*Primary Examiner*—Hien Vu
(74) *Attorney, Agent, or Firm*—Bacon & Thomas, PLLC

(57) ABSTRACT

A battery connector has an insulative housing, a plurality of contact terminals mounted in the insulative housing and a washer mounted on the insulative housing. The insulative housing has a first surface, a second surface, a third surface and a plurality of notches defined through the third surface. Each notch communicates with a first opening and a second opening respectively defined on the first surface and the second surface. Each contact terminal has a flat base portion and a U-shaped resilient portion extending from the base portion. The base portion has a second contact portion. The resilient portion has a first contact portion. The washer encloses around the periphery of the insulative housing and is adjacent to the first surface. Therefore, when the battery connector is mounted to a circuit board, the washer prevents or moisture from getting into the battery connector.

9 Claims, 5 Drawing Sheets

BATTERY CONNECTOR

BACKGROUND OF THE INVENTION

1. Field of the Invention

The present invention relates to a battery connector, and more particularly to a moisture proof battery connector.

2. Description of Related Art

A battery connector is used as a device connected between a battery and an electronic product for conducting electricity to the electronic product.

Most of the electronic products may malfunction easily when they are operated in high humidity environment for a long time or fall in liquid. Particularly, since the electrical connection between the electronic product and the battery often lacks moisture proof structures, wet air may easily get into the electrical product and eventually result in a short circuit, rustiness or other abnormal situations.

To overcome the shortcomings, the present invention provides a battery connector to mitigate or obviate the aforementioned problems.

SUMMARY OF THE INVENTION

The main objective of the present invention is to provide a battery connector that prevents moisture from getting into the battery connector when the battery connector is mounted on a circuit board.

The battery connector has an insulative housing, a plurality of contact terminals mounted in the insulative housing and a washer mounted on the insulative housing. The insulative housing has a first surface, a second surface, a third surface and a plurality of notches defined through the third surface. Each notch communicates with a first opening and a second opening respectively defined on the first surface and the second surface. Each contact terminal has a flat base portion and a U-shaped resilient portion extending from the base portion. The base portion has a second contact portion. The resilient portion has a first contact portion. The washer encloses around the periphery of the insulative housing and is adjacent to the first surface. Therefore, when the battery connector is mounted to a circuit board, the washer prevents moisture from getting into the battery connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
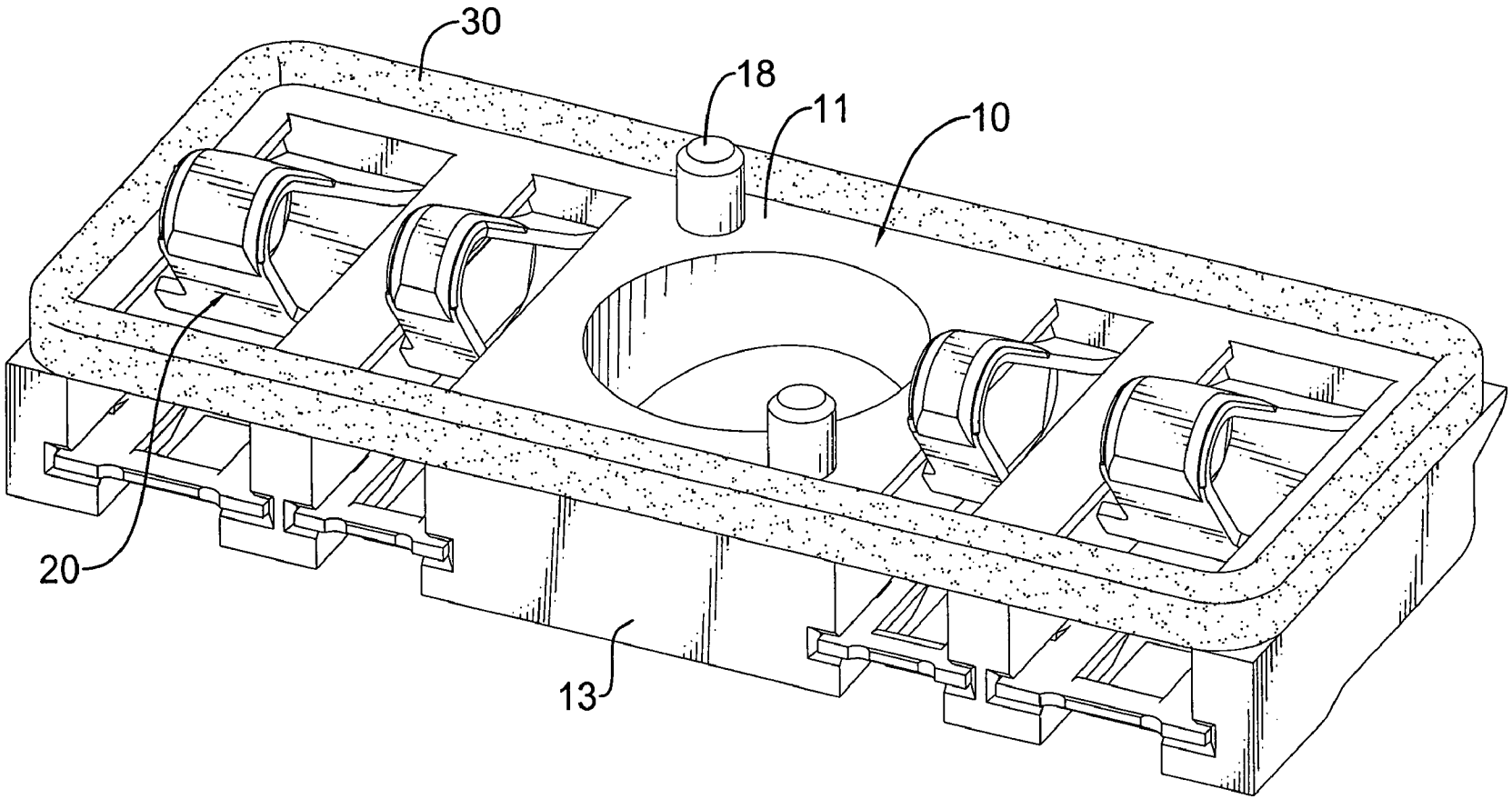
FIG. 1 is a perspective view of a battery connector in accordance with the present invention.
Figure 2:
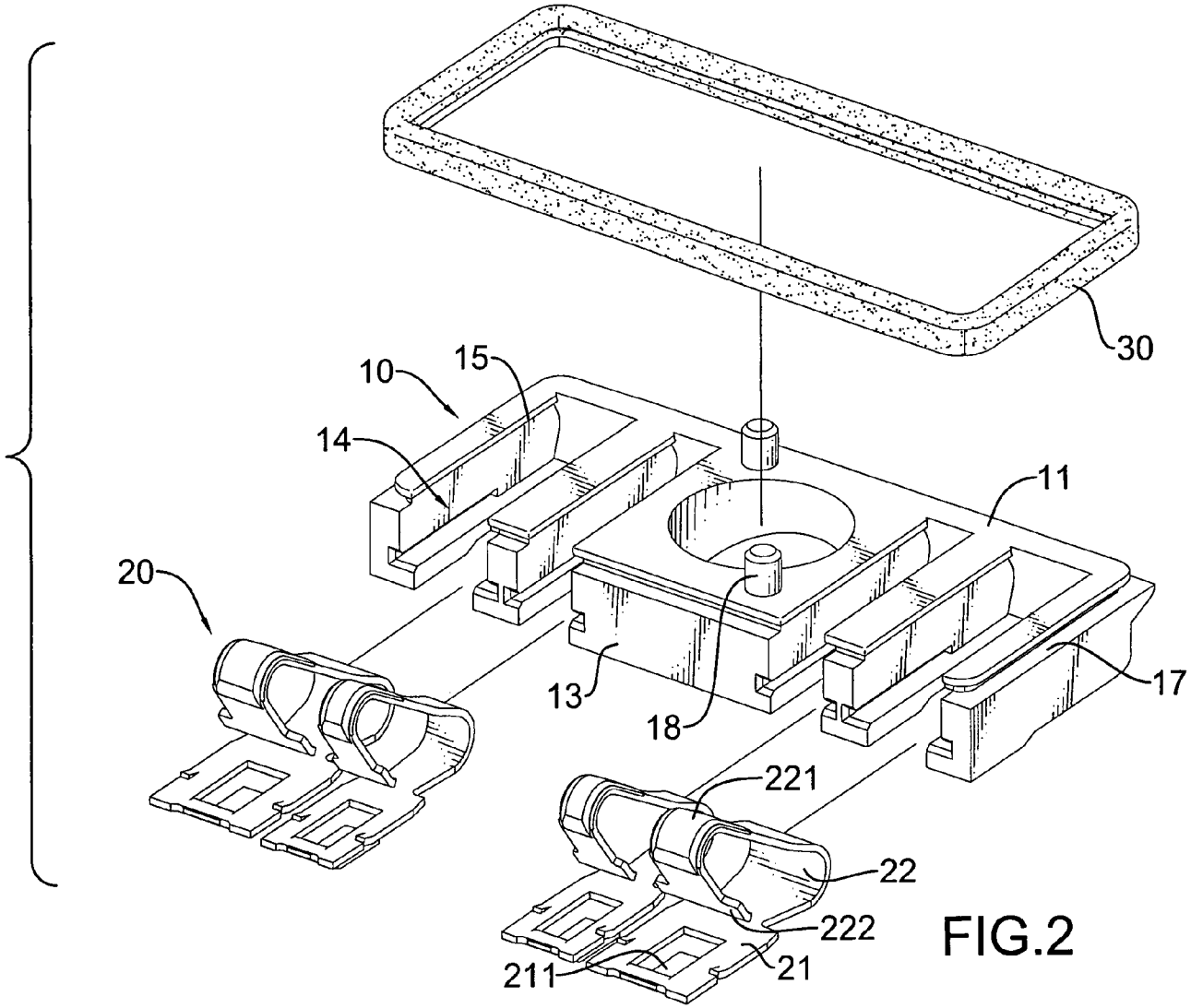
FIG. 2 is an exploded perspective view of the battery connector of FIG. 1.

With reference to FIGS. 1 and 2, a battery connector 1 in accordance with the present invention comprises an insulative housing 10, a plurality of conductive terminals 20 held in the insulative housing 10, and a washer 30 mounted on the insulative housing 10.

The insulative housing 10 has a first surface 11, a second surface 12, a side surface 13, a plurality of notches 14, a plurality of first openings 15, a plurality of second openings 16, a mounting groove 17 and optional positioning protrusions 18.

Figure 5:
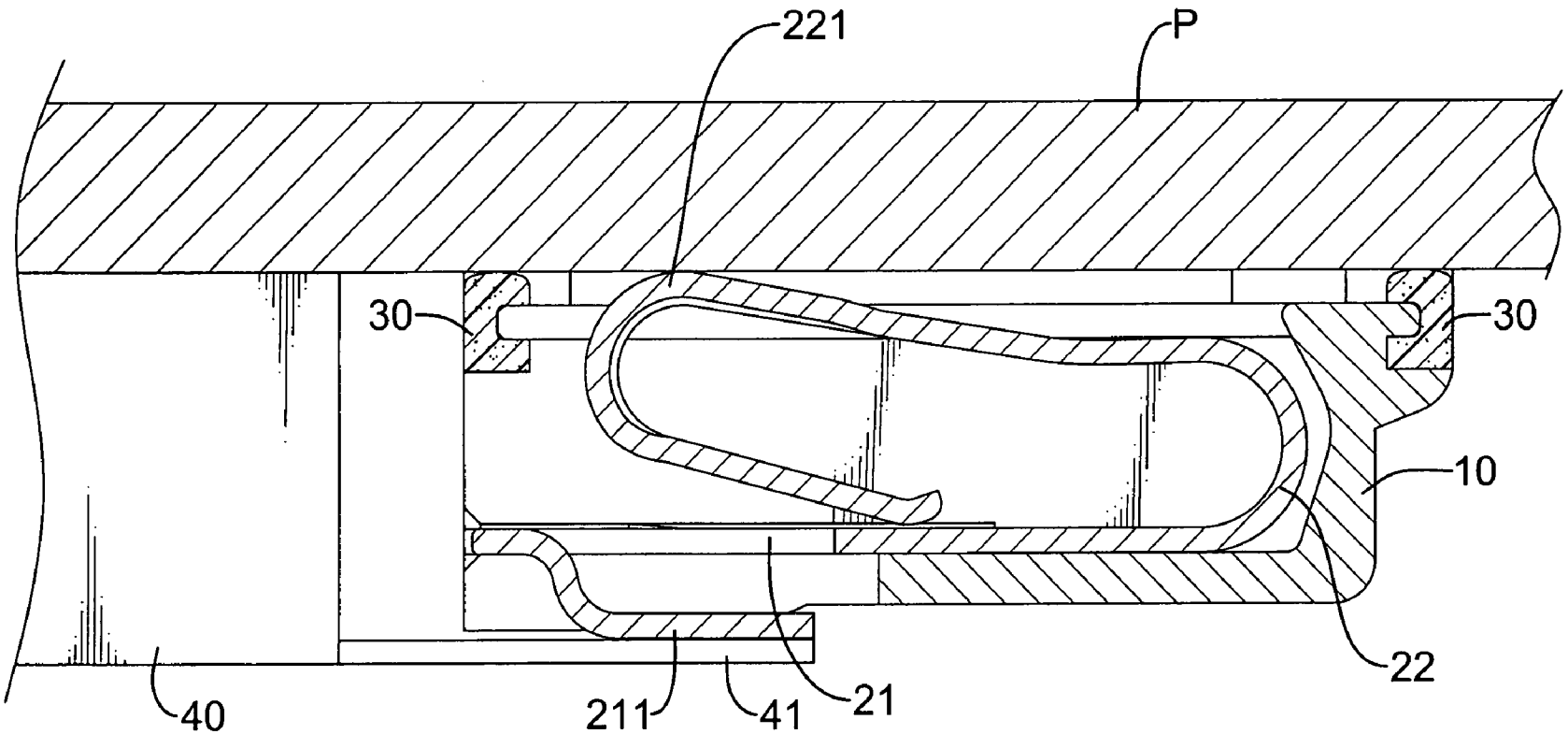
FIG. 5 is a cross sectional view of the battery connector in accordance with the present invention being attached to a circuit board and a battery.

The second surface 12 is opposite to the first surface 11. The side surface 13 is adjacent to both the first surface 11 and the second surface 12. The plurality of notches 14 is defined into the side surface 13. Each of the first openings 15 and each of the second openings 16 are respectively defined through the first surface 11 and the second surface 12, and communicate with one of the notches 14. The groove 17 is defined in a periphery of the insulative housing 10 and adjacent to the first surface 11. The positioning protrusions 18 protrude upward from the first surface 11. To assemble the battery connector 1 to a circuit board P of an electronic product as shown in FIG. 5, the positioning protrusions 18 are firmly mounted in the circuit board P.

Figure 3:
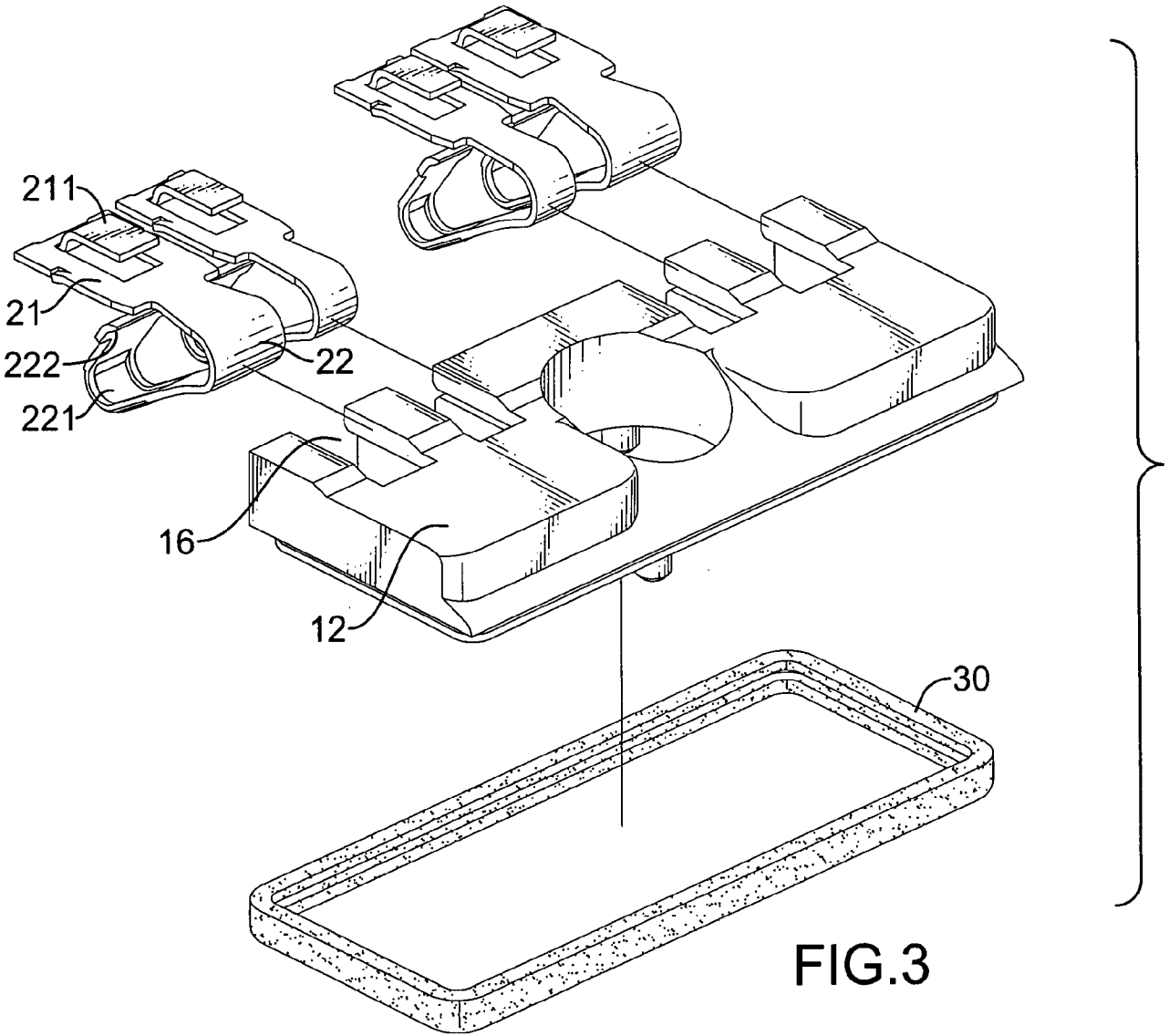
FIG. 3 is another exploded perspective view of the battery connector of FIG. 1.

With further reference to FIG. 3, each conductive terminal 20 comprises a base portion 21 and a resilient portion 22. The base portion 21 is substantially rectangular and flat and integrally has a second contact portion 211. The resilient portion 22 is substantially U-shaped, integrally extends from the base portion 21 and has a first contact portion 221.

Figure 4A:
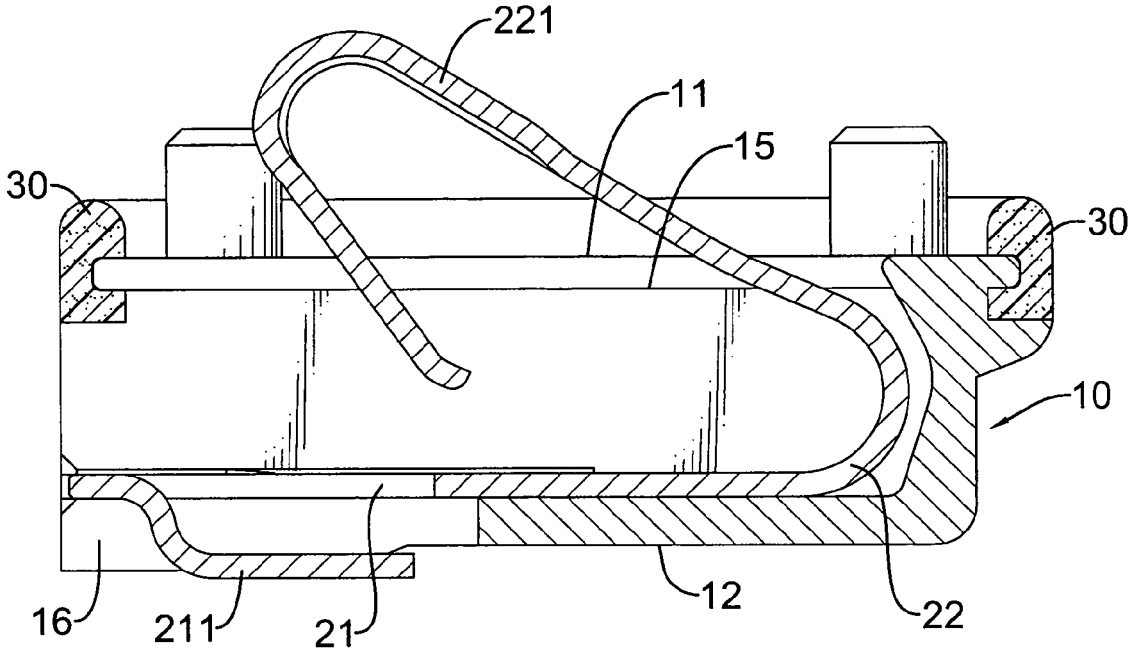
FIG. 4A is a cross sectional view of the battery connector of a first embodiment in accordance with the present invention.
Figure 4B:
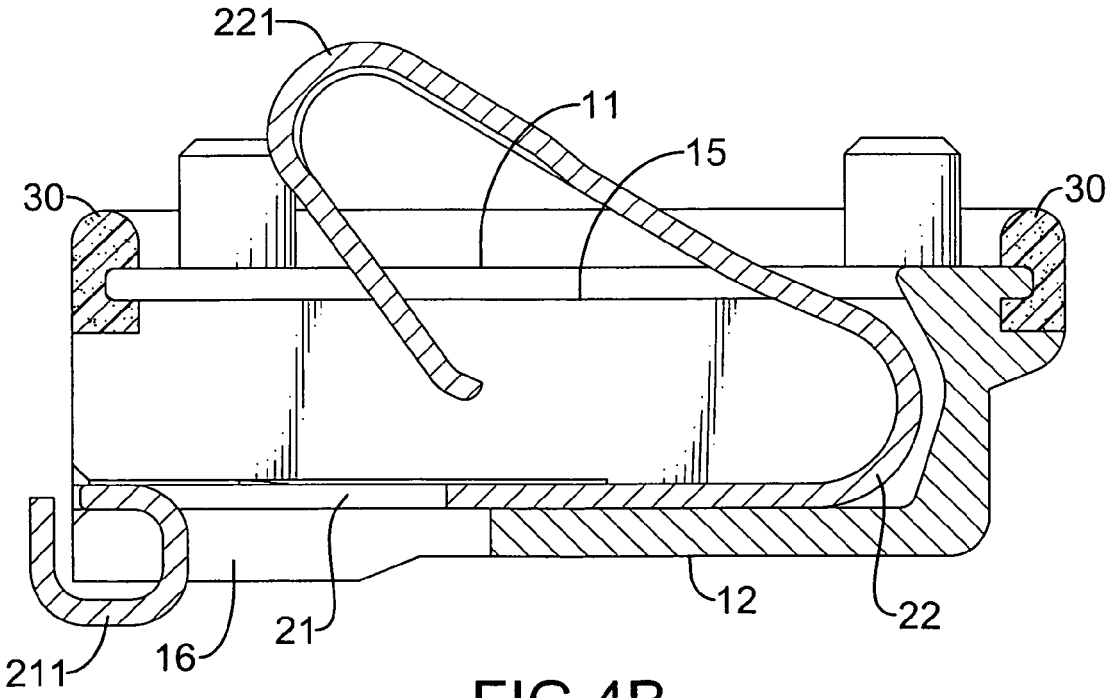
FIG. 4B is a cross sectional view of the battery connector of a second embodiment in accordance with the present invention.

With further reference to FIG. 4A, the first contact portion 221 and the second contact portion 211 are separated at opposite sides by the base portion 21. When the contact terminal 20 is assembled in the insulative housing 10, the first contact portion 221 protrudes through the first opening 15 and the second contact portion 211 protrudes through the second opening 16. In this embodiment, the second contact portion 211 extends in a direction parallel to the second surface 12. With further reference to FIG. 4B, the second contact portion 211 may extend in a direction parallel to the side surface 13 in another embodiment.

The resilient portion 22 may further has an enlarged portion 222 that integrally extends from the first contact portion 221 and is mounted in the notch 14. Since the enlarged portion 222 together with the first contact portion 221 form a T-shaped structure and the enlarged portion 222 is slightly larger than the first opening 15, the resilient portion 22 of the contact terminal 20 is limited in the notch 14. In other words, the enlarged portion 222 prevents the resilient portion 22 from suddenly springing out of the first surface 11 due to the resilient force.

With further reference to FIG. 5, the washer 30 such as an O-ring is engaged to the periphery of the insulative housing 10 near the first surface 11. Preferably, the washer 30 is engaged to the groove 17 and has a top surface of higher than the first surface 11. When the battery connector 1 is attached to the circuit board P and the first contact portion 221 electrically contacts the circuit board P, the washer 30 encloses the first surface 11 and seals the gap between the battery connector 1 and the circuit board P to prevent moisture getting into the battery connector 1 from the first opening 15. In addition, the second contact portion 211 is electrically connected to a flexible flat cable (FFC) 41 of a battery 40 such as a flat battery for a cell phone to conduct electricity to the circuit board P.

In conclusion, because the periphery of the insulative housing 10 is equipped with the washer 30 and the top surface of the washer 30 is slightly higher than the first surface 11, the washer 30 seals the gap between the battery connector 1 and the circuit board P to prevent moisture getting into the battery connector 1 from the first opening 15.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A battery connector comprising:

an insulative housing having a substantially circular through opening therein;

a periphery;

a first surface;

a second surface opposite to the first surface;

a side surface adjacent to the first surface and the second surface; and a plurality of notches defined through the side surface, and each notch communicating with a first opening and a second opening respectively defined through the first surface and the second surface;

a plurality of contact terminals mounted in the plurality of notches respectively, each contact terminal having a base portion being rectangular and flat and having a second contact portion; and a resilient portion being U-shaped, extending from the base portion and having a first contact portion; and a washer engaged in the periphery of the insulative housing and adjacent to the first surface of the insulative housing and adapted to tightly abut against a surface of a circuit board;

wherein the insulative housing further comprises a plurality of positioning protrusions formed on the first surface and adjacent to the circular through opening.

2. The battery connector as claimed in claim 1, wherein the first contact portion and the second contact portion are separated at opposite sides by the base portion.

3. The battery connector as claimed in claim 2, wherein the first contact portion protrudes through the first opening.

4. The battery connector as claimed in claim 2, wherein the second contact portion protrudes through the second opening.

5. The battery connector as claimed in claim 4, wherein the second contact portion is parallel to the second surface.

6. The battery connector as claimed in claim 4, wherein the second contact portion is parallel to the side surface.

7. The battery connector as claimed in claim 1, wherein the resilient portion further has an enlarged portion extending from the first contact portion and mounted in the notch.

8. The battery connector as claimed in claim 1, wherein the periphery of the insulative housing is defined with a groove for engaging the washer.

9. The battery connector as claimed in claim 1, wherein the washer has a top surface higher than the first surface when the washer is assembled to the insulative housing.

* * * * *